US011044954B2

(12) United States Patent
Misseldine

(10) Patent No.: US 11,044,954 B2
(45) Date of Patent: Jun. 29, 2021

(54) BRASSIERE

(71) Applicant: Creative Lingerie Limited, Hertfordshire (GB)

(72) Inventor: Jeanette Misseldine, Hertfordshire (GB)

(73) Assignee: Creative Lingerie Limited, Hertfordshire (GB)

( * ) Notice: Subject to any disclaimer, the term of this patent is extended or adjusted under 35 U.S.C. 154(b) by 80 days.

(21) Appl. No.: 16/606,438

(22) PCT Filed: Apr. 20, 2018

(86) PCT No.: PCT/GB2018/051048
§ 371 (c)(1),
(2) Date: Oct. 18, 2019

(87) PCT Pub. No.: WO2018/193270
PCT Pub. Date: Oct. 25, 2018

(65) Prior Publication Data

US 2021/0106075 A1 Apr. 15, 2021

(30) Foreign Application Priority Data

Apr. 20, 2017 (GB) ..... 1706335
Feb. 21, 2018 (GB) ..... 1802764

(51) Int. Cl.
*A41C 3/00* (2006.01)
*A41C 3/14* (2006.01)

(52) U.S. Cl.
CPC ..... *A41C 3/0057* (2013.01); *A41C 3/0021* (2013.01); *A41C 3/142* (2013.01)

(58) Field of Classification Search
CPC ..... A41C 3/0057; A41C 3/0021; A41C 3/142
(Continued)

(56) References Cited

U.S. PATENT DOCUMENTS 3,642,009 A 2/1972 Nobbs
3,699,971 A 10/1972 Hittel et al.
(Continued)

FOREIGN PATENT DOCUMENTS

GB 2064301 A 6/1981
JP 3175705 U 5/2012
JP 2013213304 A 10/2013

OTHER PUBLICATIONS

United Kingdom Intellectual Property Office, Patents Act 1977: Combined Search and Examination Report under Sections 17 and 18(3), Application No. GB1802764.9, dated Mar. 29, 2018 (8 pages).

(Continued)

*Primary Examiner* — Gloria M Hale
(74) *Attorney, Agent, or Firm* — Wood Herron & Evans LLP

(57) ABSTRACT

The present invention relates generally to brassieres, particularly to brassieres for fuller figured and plus size women, and more particularly to brassieres for fuller figured and plus size women to wear during sporting activities. According to a first aspect of the present invention, there is provided a brassiere comprising a cradle, two straps and two cups each for receiving a breast, each of the cups having an around cup edge section, an underarm edge section, a neckline edge section, a center edge section and an apex, wherein the brassiere further comprises a Y-shaped control panel generally extending from the straps across the top of the neckline edge section of each of the cups and down the center edge section of each of the cups to the cradle.

11 Claims, 2 Drawing Sheets

(58) Field of Classification Search
USPC ..... 450/39
See application file for complete search history.

(56) References Cited

U.S. PATENT DOCUMENTS

| | | | | |
|---|---|---|---|---|
| 4,254,777 | A | 3/1981 | Johnston | |
| 4,340,064 | A * | 7/1982 | Vale | A41C 3/0057 450/72 |
| 7,435,155 | B2 * | 10/2008 | Reinisch | A41C 3/0028 450/59 |
| 10,477,902 | B1 * | 11/2019 | Blecha | A41C 3/0057 |
| 2006/0252346 | A1 * | 11/2006 | Reinisch | A41C 3/0028 450/86 |
| 2012/0122370 | A1 | 5/2012 | Heath et al. | |
| 2018/0242653 | A1 * | 8/2018 | Brandt | B32B 5/24 |
| 2019/0098940 | A1 * | 4/2019 | Huffa | A41C 3/126 |

OTHER PUBLICATIONS

European Patent Office, International Search Report and Written Opinion of the International Searching Authority, International Application No. PCT/GB2018/051048, dated Jul. 12, 2018 (10 pages).

* cited by examiner

BRASSIERE

CROSS-REFERENCE TO RELATED APPLICATIONS

This application is a submission under 35 U.S.C. § 371 of International Application No. PCT/GB2018/051048, filed Apr. 20, 2018, which claims priority to Great Britain Application No. 1802764.9, filed Feb. 21, 2018, and Great Britain Application No. 1706335.5, filed Apr. 20, 2017, the disclosures of which are hereby expressly incorporated by reference herein in their entireties.

FIELD OF THE INVENTION

The present invention relates generally to brassieres, particularly to brassieres for fuller figured and plus size women, and more particularly to brassieres for fuller figured and plus size women to wear during sporting activities.

BACKGROUND OF THE INVENTION

Fuller figured and plus size women generally have larger breasts that need to be supported. Thus brassieres for fuller figured and plus size women tend to be more structured in order to provide the required level of support for the larger breasts.

The problem is that as the size of the breast increases the bust has a tendency to bounce and jiggle about more than a smaller bust. This often results in pain for the woman who wants to participate in sporting activities as stress is put on the pectoral muscle with the vertical bounce movement of fuller figured and plus size women.

This problem is much worse in plus size women as the brassiere, being tight around the body to provide support, results in the bust being pushed either upwards or flattened in an attempt to reduce the movement.

Furthermore, the majority of sports bras are not functional and supportive enough as the vertical problem of movement has not been considered enough in traditional bra brands and the average woman has lost all faith in the product available to her for wear whilst participating in sporting activities.

The wearing of such uncomfortable brassieres can result in significant sagging of the bust as the muscles are put under tremendous pressure.

SUMMARY OF THE INVENTION

According to a first aspect of the present invention, there is provided a brassiere comprising a cradle, two straps and two cups each for receiving a breast, each of the cups having an around cup edge section, an underarm edge section, a neckline edge section, a center edge section and an apex, wherein the brassiere further comprises a Y-shaped control panel generally extending from the straps across the top of the neckline edge section of each of the cups and down the center edge section of each of the cups to the cradle.

In one embodiment, the cradle comprises an under band, two side panels extending from the under band and two wings extending from the side panels. In one alternative the side panels are formed integrally with the wings, and in another alternative a side seam is provided to connect the side panels to the wings, the side seam may be vertical or angled. In a further alternative the side seam may be provided with a bone or other ridged structure.

The Y-shaped control panel may connect to the cradle, and the Y-shaped control panel may connect to the under band of the cradle.

The Y-shaped control panel may join to the under band of the cradle and surround neckline edge sections and center edge sections of the cups.

The around cup section of the cups may be provided with a wire.

The Y-shaped control panel may comprise a double bonded fabric. A double bonded fabric comprises two or more pieces of fabric that have been glued or bonded together to form a laminate. The double bonded fabric may comprise two or more pieces of fabric that have been glued or bonded together using a Hot Melt bonding system to form a laminate. The fabric may comprise a rigid fabric, and the fabric may be totally or completely rigid. The fabric may comprise an Interlock construction fabric. The fabric may comprise 100% polyamide. The fabric may comprise a Nylon fabric with Interlock construction. The fabric may comprise a Nylon fabric with Interlock construction that is completely rigid. The advantage of 100% polyamide fabric is that is doesn't have an inherent ability to stretch, which when laminated makes it strong and stiff.

In the alternative, the Y-shaped control panel comprises any other rigid construction stiff fabric.

The advantage of using a rigid construction stiff fabric that is bonded together in a laminate, which is different from other qualities, means it's thicker and more robust, rigid and sturdy than just a single layer of fabric. In the alternative, it is possible to create a fabric that is super heavy and thick that is very rigid. The glue is a lamination technique that sticks two or more layers of fabric together.

The cups may be foam cups or, alternatively, the cups could each be formed from an alternative single piece of fabric or multiple pieces of fabric joined together.

The Y-shaped control panel may comprise two mirror image sections of half a Y vertically that are connected together.

The mirror image sections may be sewn together to create the Y-shaped control panel. By creating the Y-shaped control panel in two mirror image sections, the sections are able to curve and enables the sections to sit against the body to separate the bust. The reason why most bras don't perform well is that the bust is not separated.

The Y-shaped control panel may be a mirror image with a shaped center seam in the middle of the Y. This seam pulls and holds the brassiere towards the rib cage, therefore separating the bust and stopping the usual sausage effect called a "monoboob". The mirror seam at the front, teamed with the bonded robust construction fabric, encapsulates the brassiere around the bust and holds its position and stops any movement.

The Y-shaped control panel may be joined to the cradle which may also be formed from a double bonded fabric which finally completes the around bust restriction.

Alternatively, the Y-shaped control panel comprises a single section.

The Y-shaped control panel may be connected to the cups with stitching. In the alternative, the Y-shaped control panel is connected to the cups with bonded glue, or other suitable method that is permanent and strong.

The under band and the side panels of the cradle may comprise a double bonded fabric. The double bonded fabric may comprise two or more pieces of fabric that have been glued or bonded together using a Hot Melt bonding system to form a laminate. The fabric may comprise a rigid fabric, and the fabric may be totally or completely rigid. The fabric may comprise an Interlock construction fabric. The fabric may comprise 100% polyamide. The fabric may comprise a Nylon fabric with Interlock construction. The fabric may comprise a Nylon fabric with Interlock construction that is completely rigid.

The Y-shaped control panel about the straps and neckline may be edged with an elastic over binding, which prevents chafing.

BRIEF DESCRIPTION OF THE DRAWINGS

The accompanying drawings, which are incorporated in and constitute a part of this specification, illustrate embodiments of the present invention and, together with a general description of the present invention given above, and the detailed description of the embodiments given below, serve to explain the principles of the present invention.

DETAILED DESCRIPTION OF THE INVENTION

Figure 1:
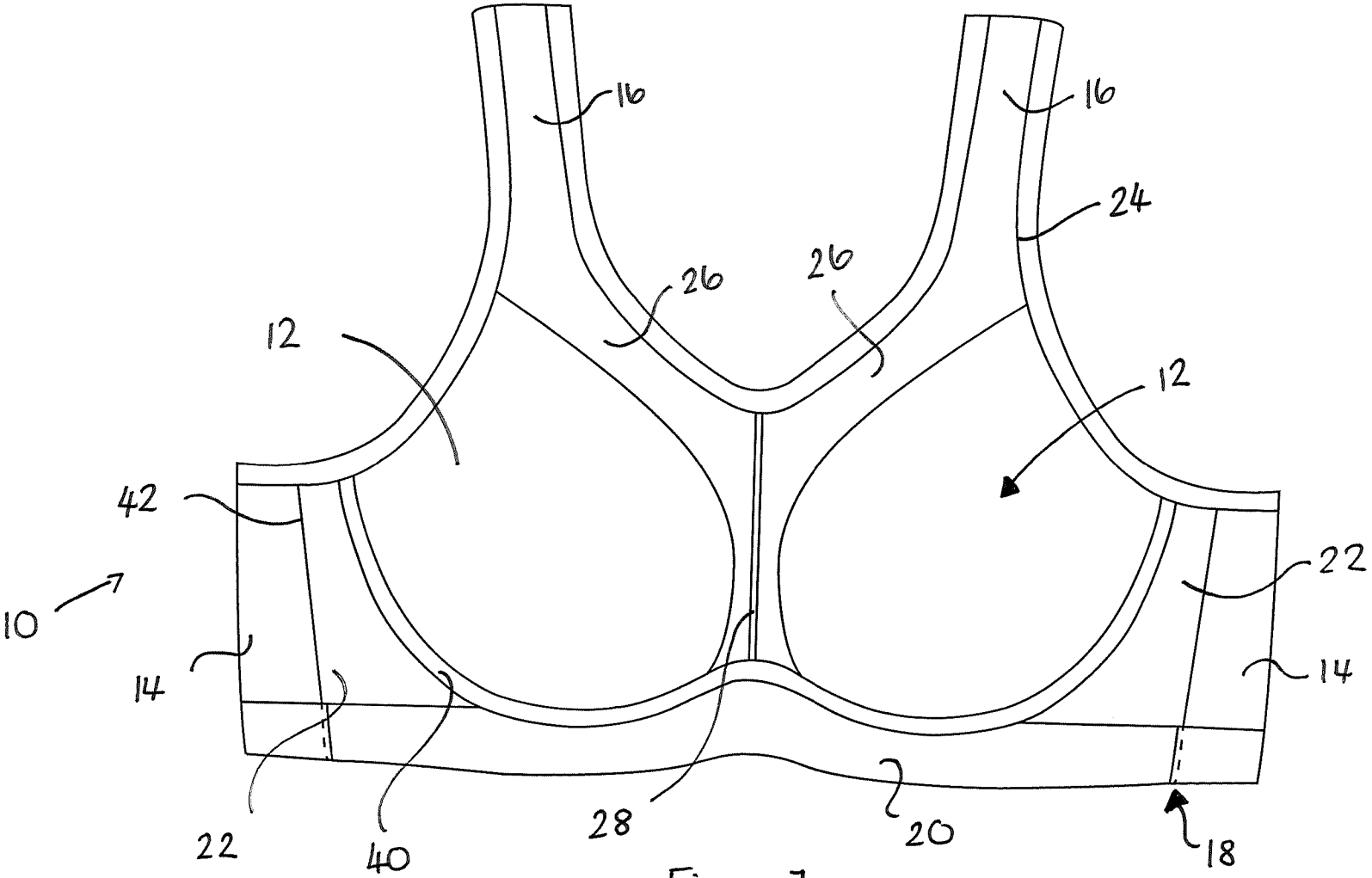
FIG. 1 illustrates a front view of a brassiere of the present invention according to a first embodiment.

FIG. 1 illustrates a brassiere 10 according to a first embodiment of the present invention. The brassiere 10 has two cups 12 to hold the breasts, a cradle 18 formed of an under band 20 and two side panels 22, two wings 14 (only a portion of each are visible in this figure) that wrap around the wearer's torso, two shoulder straps 16 and a Y-shaped control panel 24. In one alternative, the side panels 22 are formed integrally with the wings 14, and in another alternative, a side seam 42 is provided to connect the side panels 22 to the wings 14 as illustrated in FIG. 1. The side seam 42 may be vertical as illustrated in FIG. 1 or angled. In a further alternative, the side seam 42 may be provided with a bone or other ridged structure (not illustrated).

The wings 14 may be closed in at the back by a hook and eye fastener system. The type of fastener system is not limited to a hook and eye fastener system, this is simply the fastener system most commonly used in brassieres. Further, in the alternative, the wings 14 may not be provided with an opening and may simply be a continuous band which the user positions in place by pulling the brassiere on over the head for example.

Yet further in the alternative, the straps 16 may cross over at the back.

The cups 12 of the brassiere may be of seamless or molded construction being a preformed foam cup. The construction of the cups 12 is not essential to the present invention, and may in the alternative be formed from three panels or two panels.

The cups 12 may have an around cup edge section, an underarm edge section, a neckline edge section which merges into the center edge section and an apex.

The Y-shaped control panel 24 generally extends from the straps 16 across the top of the neckline edge section of each of the cups 12 and down the center edge section of each of the cups to the cradle 18.

The Y-shaped control panel 24 connects to the cradle 18, specifically the Y-shaped control panel 24 connects to the under band 20 of the cradle 18.

The Y-shaped control panel 24 joins to the under band 20 of the cradle 18 and surrounds neckline edge sections and center edge sections of the cups 12.

The around cup section of the cups 12 may optionally be provided with a wire 40.

The Y-shaped control panel 24 may be formed from a double bonded fabric. A double bonded fabric comprises two or more pieces of fabric that have been glued or bonded together to form a laminate. The double bonded fabric may comprise two or more pieces of fabric that have been glued or bonded together using a Hot Melt bonding system to form a laminate. The fabric may comprise a rigid fabric, and the fabric may be totally or completely rigid. The fabric may comprise an Interlock construction fabric. The fabric may comprise 100% polyamide. The fabric may comprise a Nylon fabric with Interlock construction. The fabric may comprise a Nylon fabric with Interlock construction that is completely rigid. The advantage of 100% polyamide fabric is that is doesn't have an inherent ability to stretch which, when laminated, makes it strong and stiff. The advantage of 100% polyamide fabric is that is doesn't have an inherent ability to stretch which when laminated makes it strong and stiff.

In the alternative, the Y-shaped control panel 24 comprises any other rigid construction stiff fabric.

The advantage of using a rigid construction stiff fabric that is bonded together in a laminate, which is different from other qualities, means it's thicker and more robust, rigid and sturdy than just a single layer of fabric. In the alternative, it is possible to create a fabric that is super heavy and thick that is very rigid. The glue is a lamination technique that sticks two or more layers of fabric together.

In the embodiment illustrated in FIG. 1, the Y-shaped control panel 24 comprises two mirror image sections 26 of half a Y vertically that are connected together along length 28.

The mirror image sections are sewn together to create the Y-shaped control panel. By creating the Y-shaped control panel 24 in two mirror image sections 26, the mirror image sections 26 are able to curve and enables the mirror image sections 26 to sit against the body to separate the bust. The reason why most bras don't perform well is that the bust is not separated.

The Y-shaped control panel 24 is a mirror image with a shaped center seam in the middle of the Y. This seam pulls and holds the brassiere towards the rib cage, therefore separating the bust and stopping the usual sausage effect called a "monoboob". The mirror seam at the front, teamed with the bonded robust construction fabric, encapsulates the brassiere around the bust and holds its position and stops any movement.

The Y-shaped control panel 24 may be joined to the cradle which is also formed from a double bonded fabric which finally completes the around bust restriction.

In the alternative, the Y-shaped control panel 24 may be formed from a single section.

The Y-shaped control panel 24 may be connected to the cups 12 with stitching. In the alternative, the Y-shaped control panel 24 is connected to the cups 12 with bonded glue, or other suitable method that is permanent and strong.

The under band 20 and the side panels 22 of the cradle 18 may also formed from a double bonded fabric. The double bonded fabric may comprise two or more pieces of fabric that have been glued or bonded together using a Hot Melt bonding system to form a laminate. The fabric may comprise a rigid fabric, and the fabric may be totally or completely rigid. The fabric may comprise an Interlock construction fabric. The fabric may comprise 100% polyamide. The fabric may comprise a Nylon fabric with Interlock construction. The fabric may comprise a Nylon fabric with Interlock construction that is completely rigid.

The Y-shaped control panel 24 about the straps 16 and neckline may be edged with an elastic over binding, which prevents chafing which can be sewn or glued or otherwise permanently attached.

Figure 2:
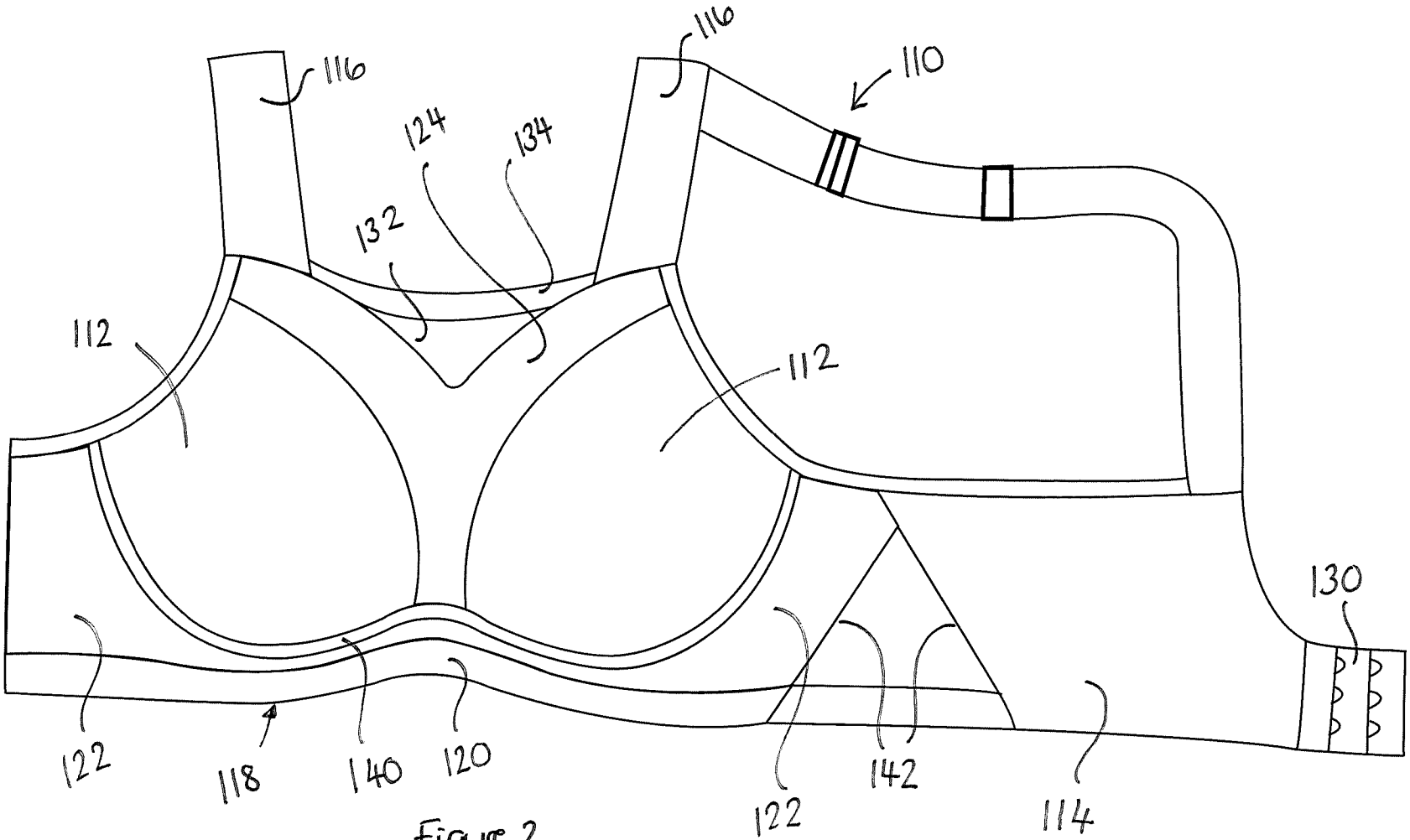
FIG. 2 illustrates a front view of a brassiere of the present invention according to a second embodiment.

FIG. 2 illustrates a brassiere 110 according to a second embodiment of the present invention. The brassiere 110 has two cups 112 to hold the breasts, a cradle 118 formed of an under band 120 and two side panels 122, two wings 114 (which are not fully visible in this figure) that wrap around the wearer's torso, two shoulder straps 116 and a Y-shaped control panel 124. In one alternative, the side panels 122 are formed integrally with the wings 114, and in another alternative, a side seam 142 is provided to connect the side panels 122 to the wings 114 as illustrated in FIG. 2. The side seam 142 may be vertical or angled as illustrated in FIG. 2. FIG. 2 illustrates that the side seam 142 may be angled forwards or backwards. In a further alternative, the side seam 142 may be provided with a bone or other ridged structure (not illustrated).

The wings 114 may be closed in at the back by a hook and eye fastener system 130. The type of fastener system is not limited to a hook and eye fastener system 130, this is simply the fastener system most commonly used in brassieres. Further, in the alternative the wings 114 may not be provided with an opening and may simply be a continuous band which the user positions in place by pulling the brassiere on over the head for example.

Yet further in the alternative, the straps 116 may cross over at the back.

The cups 112 of the brassiere may be of seamless or molded construction being a preformed foam cup. The construction of the cups 112 is not essential to the present invention, and may in the alternative be formed from three panels or two panels. The cups 112 can be individual panels which are sewn together with or without foam.

The cups 112 may have an around cup edge section, an underarm edge section, a neckline edge section which merges into the center edge section and an apex.

The Y-shaped control 124 panel generally extends from the straps 116 across the top of the neckline edge section of each of the cups 112 and down the center edge section of each of the cups to the cradle 118.

The Y-shaped control panel 124 connects to the cradle 118, specifically the Y-shaped control panel 124 connects to the under band 120 of the cradle 118.

The Y-shaped control panel 124 joins to the under band 120 of the cradle 118 and surrounds neckline edge into the center edge sections of the cups 112.

The around cup section of the cups 112 may optionally be provided with a wire 140.

The Y-shaped control panel 124 may be formed from a double bonded fabric. A double bonded fabric comprises two pieces of fabric that have been glued or bonded together to form a laminate. The double bonded fabric may comprise two pieces of fabric that have been glued or bonded together using a Hot Melt bonding system to form a laminate. The fabric may comprise a rigid fabric, and the fabric may be totally or completely rigid. The fabric may comprise an Interlock construction fabric. The fabric may comprise 100% polyamide. The fabric may comprise a Nylon fabric with Interlock construction. The fabric may comprise a Nylon fabric with Interlock construction that is completely rigid. The advantage of 100% polyamide fabric is that is doesn't have an inherent ability to stretch which when laminated makes it strong and stiff.

In the alternative, the Y-shaped control panel comprises any other rigid construction stiff fabric.

The advantage of using a rigid construction stiff fabric that is bonded together in a laminate, which is different from other qualities, means it's thicker and more robust, rigid and sturdy than just a single layer of fabric. In the alternative, it is possible to create a fabric that is super heavy and thick that is very rigid. The glue is a lamination technique that sticks two layers of fabric together.

In this embodiment, the Y-shaped control panel 124 is formed from a single section. However, in the alternative the Y-shaped control panel 124 may be formed from 2 mirror image sections as illustrated in FIG. 1.

The Y-shaped panel 124 is connected to the cups 112 with stitching. In the alternative, the Y-shaped control panel 124 is connected to the cups 112 with bonded glue, or other suitable method that is permanent and strong.

The under band 120 and the side panels 122 of the cradle 118 may also be formed from a double layer of fabric which can be sewn or bonded together so long as it is permanent. In addition, the layers of fabric can cross over if the design requires so long as the areas of cross over are strong and supportive.

The Y-shaped control panel 124 about the straps 116 and neckline may be edged with a cover panel 132 and edging 134 with over binding, which prevents chafing.

While the present invention has been illustrated by description of various embodiments and while those embodiments have been described in considerable detail, it is not the intention of Applicant to restrict or in any way limit the scope of the appended claims to such details. Additional advantages and modifications will readily appear to those skilled in the art. The present invention in its broader aspects is therefore not limited to the specific details and illustrative examples shown and described. Accordingly, departures may be made from such details without departing from the spirit or scope of Applicant's invention.

What is claimed is:

1. A brassiere comprising:

a cradle;

two straps; and two molded preformed rigid foam cups each for receiving a breast, each of the cups having:

an underarm edge section;

a neckline edge section;

a center edge section;

an apex; and an around cup edge section extending from an end of the underarm edge section to a start of the center edge section, wherein the brassiere further comprises a Y-shaped control panel comprising a rigid double bonded fabric generally extending from the straps across a top of the neckline edge section of each of the cups and down the center edge section of each of the cups to the cradle, wherein the cradle comprises an under band comprising a rigid double bonded fabric, two side panels comprising a rigid double bonded fabric extending from the under band and two wings extending from the side panels, and wherein the Y-shaped control panel connects to the under band of the cradle and surrounds the neckline edge sections and center edge sections of the cups.

2. The brassiere as claimed in claim 1, wherein the rigid double bonded fabric comprises a double bonded rigid polyamide.

3. The brassiere as claimed in claim 1, wherein the rigid double bonded fabric comprises a double bonded rigid interlock construction polyamide.

4. The brassiere as claimed in claim 1, wherein the Y-shaped control panel comprises two mirror image sections of half a Y vertically that are connected together.

5. The brassiere as claimed in claim 4, wherein the mirror image sections are sewn together to create the Y-shaped panel.

6. The brassiere as claimed in claim 1, wherein the Y-shaped control panel comprises a single section.

7. The brassiere as claimed in claim 1, wherein the Y-shaped control panel is connected to the cups with stitching.

8. The brassiere as claimed in claim 1, wherein the under band and the side panels of the cradle comprise a double bonded rigid polyamide.

9. The brassiere as claimed in claim 1, wherein the under band and the side panels of the cradle comprise a double bonded rigid interlock construction polyamide.

10. The brassiere as claimed in claim 1, wherein the Y-shaped control panel about the straps and neckline is edged with an elastic over binding.

11. The brassiere as claimed in claim 1, wherein the around cup section of the cups are provided with a wire.

* * * * *